US009379478B2

(12) United States Patent
Fabre et al.

(10) Patent No.: US 9,379,478 B2
(45) Date of Patent: Jun. 28, 2016

(54) ELECTRICAL CONNECTOR

(71) Applicant: DELPHI INTERNATIONAL OPERATIONS LUXEMBOURG S.A.R.L., Bascharage (LU)

(72) Inventors: Jean Fabre, Chartres (FR); Gilles Schmitt, Senantes (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 0 days.

(21) Appl. No.: 14/421,195

(22) PCT Filed: Oct. 15, 2012

(86) PCT No.: PCT/IB2012/002343

§ 371 (c)(1),
(2) Date: Feb. 12, 2015

(87) PCT Pub. No.: WO2014/060789

PCT Pub. Date: Apr. 24, 2014

(65) Prior Publication Data

US 2015/0207263 A1 Jul. 23, 2015

(51) Int. Cl.

| | |
|---|---|
| ***H01R 13/659*** | (2011.01) |
| ***H01R 13/52*** | (2006.01) |
| ***H01R 13/506*** | (2006.01) |
| ***H01R 13/6581*** | (2011.01) |
| ***H01R 43/00*** | (2006.01) |
| *H01R 13/74* | (2006.01) |

(52) U.S. Cl.

CPC ..... *H01R 13/5202* (2013.01); *H01R 13/506* (2013.01); *H01R 13/6581* (2013.01); *H01R 43/00* (2013.01); *H01R 13/748* (2013.01); *H01R 2201/26* (2013.01); *Y10T 29/49208* (2015.01)

(58) Field of Classification Search

CPC ..... H01R 13/5208; H01R 13/5205; H01R 13/659; H01R 9/032

See application file for complete search history.

(56) References Cited

U.S. PATENT DOCUMENTS

| | | | | |
|---|---|---|---|---|
| 7,204,716 | B1 * | 4/2007 | George | H01R 13/5205 439/275 |
| 2009/0124121 | A1 * | 5/2009 | Matsuoka | H01R 4/183 439/550 |
| 2012/0100753 | A1 | 4/2012 | Omae et al. | |

(Continued)

FOREIGN PATENT DOCUMENTS

| | | | |
|---|---|---|---|
| WO | 2008109109 | A1 | 9/2008 |
| WO | 2010015889 | A1 | 2/2010 |

(Continued)

OTHER PUBLICATIONS

International Search Report for PCT/IB2012/002343, published Jun. 10, 2013.

*Primary Examiner* — Gary Paumen
(74) *Attorney, Agent, or Firm* — Robert J Myers

(57) ABSTRACT

An electrical connector including a housing made of rigid electrically insulating material and having an outer portion and an inner portion designed to receive an electrical terminal, a shielding made of electrically conductive material surrounding the inner portion including a rear extension, a sealing system including an outer seal, and an inner seal provided between the inner portion and the shielding. A method for assembling such an electrical connector is also presented.

8 Claims, 5 Drawing Sheets

(56) References Cited

U.S. PATENT DOCUMENTS

| | | | | |
|---|---|---|---|---|
| 2012/0295479 | A1 | 11/2012 | Omae et al. | |
| 2014/0051286 | A1* | 2/2014 | Itsuki | H01R 13/533 439/587 |
| 2014/0120767 | A1* | 5/2014 | Itsuki | H01R 13/5208 439/587 |

FOREIGN PATENT DOCUMENTS

| | | | |
|---|---|---|---|
| WO | 2011096135 | A1 | 8/2011 |
| WO | 2011097007 | A1 | 8/2011 |
| WO | 2012056325 | A1 | 5/2012 |
| WO | 2013010680 | A1 | 1/2013 |

* cited by examiner

ELECTRICAL CONNECTOR

CROSS-REFERENCE TO RELATED APPLICATION

This application is a national stage application under 35 U.S.C. §371 of PCT Application Number PCT/IB2012/002343 having an international filing date of Oct. 15, 2012, which designated the United States, the entire disclosure of each of which are hereby incorporated herein by reference.

TECHNICAL FIELD OF THE INVENTION

The present invention relates to electrical connectors and electrical assemblies including such connectors. In particular, the present invention relates to an electrically shielded connector providing a shielded electrical connection between such electrically shielded connector and a complementary electrical connector with electrical wires, as those used in today hybrid or electric vehicles. Some electrical connectors are intended to receive two or more electrical terminals attached to electrical wires, and are provided with a shielding surrounding the terminals and the end portion of the wires received in electrical connectors.

BACKGROUND OF THE INVENTION

Typically, such shielding ring grounded electrically conductive systems and are means to prevent a leaking of electromagnetic waves and interferences outside/inside the shielding and to protect signals carried by these or other wires and devices.

Therefore, an insulator should be provided between the terminal(s) or wire(s) and the conductive system in order to prevent any contact between them. When mating the electrical connector to the complementary electrical connector, a specific solution is needed to keep required sealing and shielding properties of the electrical connection.

An electrical connector assembly including an electrical connector body portion having a body shield system inside the housing and a metal shield plate providing electrical continuity between the body shield member and electrical devices on which the connector body is fastened is known from WO2012056325.

Nevertheless, the electrical car industry faces increasing needs for high electrical power connector assemblies with electromagnetic shielding effectiveness together with resistance to humidity while keeping its shielding and easy assembly/disassembly properties.

An appropriate shielding solution ought to reduce electromagnetic disturbances, notably at the point of the electrical connection between a shield and a complementary shielding part, while keeping an easy, quick and efficient assembly/disassembly process.

Particularly, when a shielding system is provided as the assembly of two or more shielding shells, where the ends of the shells are superimposed to ensure electrical contacts between them, unwanted water may circulate between the two superimposed shells and, consequently, such water can reach, for instance, the device onto which the connector body is mounted.

BRIEF SUMMARY OF THE INVENTION

In accordance with an embodiment of the invention, the sealed and shielded electrical connector includes:

- a housing made of hard electrically insulating material having an outer portion and an inner portion designed to receive an electrical terminal, wherein the housing extends from its rear section to a front section,
- a single piece shielding made of electrically conductive material surrounding the inner portion, extending from a rear section to a front section, and including a rear extension,
- a sealing system including an outer seal provided between the shielding and the outer portion of the housing, and an inner seal provided between the inner portion and the shielding.

Thanks to these dispositions, the electromagnetic shielding protection of an electrical connection between an electrical cable and a respective electrical device is ensured, while a sealing is provided between on both the inner and outer surfaces of the shielding.

In some other embodiments, one might also use one or more of the features as defined in the dependent claims.

In accordance with another embodiment of the invention, an assembly method for assembling an electrical connector is provided. The method includes providing the sealed and shielded electrical connector according to the invention having the above-mentioned features.

This method may further include the steps of:

- mounting the single piece shielding on the inner portion, wherein an aperture cooperates with a locking system of the shielding in order to ensure a stable connection between them,
- inserting the outer seal on the rear extension of the shielding,
- mounting the outer portion on the shielding, whereby the outer seal provides a sealing continuity between the rear extension of the shielding and the outer portion, and wherein the a latching element of the outer portion cooperates with the groove in order to ensure a fixed position between them, and
- mounting the inner seal on the rear section of the inner portion, wherein the inner seal provides a sealing continuity between the inner portion and the shielding.

In accordance with yet another embodiment of the invention, a connector assembly including a connector as above-mentioned and a device having a wall onto which this connector is mounted is provided and wherein the rear extension is enclosed between the outer seal, the inner seal and the wall.

With these features, it is provided a simple and a reliable sealed shielding electrical connection without losing any of the requested functions. Thus, the embodiment provides electrical connection safer, time resistant, less costly for maintenance and with minimized leak of electromagnetic interferences inside/outside the electrical wires. In particular, the shielding portion of the shield, which will be in electrical contact with a shield of a complementary electrical device, is sealed.

Any of the connector embodiments including a sealed shielding as described above may be used in an assembly including any of the above described systems and a complementary connection.

Further information is provided in the detailed description. In some embodiments, one might also use one or more of the features of the claims taken alone or in combination.

Of course, different features, alternatives and/or embodiments of the present invention can be combined with each other in various arrangement to the extent that they are not incompatible or mutually exclusive of others.

BRIEF DESCRIPTION OF THE SEVERAL VIEWS OF THE DRAWING

The present invention will now be described, by way of example with reference to the accompanying drawings, in which.

It should be noted that, in the Figures, structural and/or functional elements which are common to different embodiments may have the same reference sign. Thus, unless otherwise stated, these elements have structural, dimensional and material properties which are identical.

DETAILED DESCRIPTION OF THE INVENTION

Figure 1:
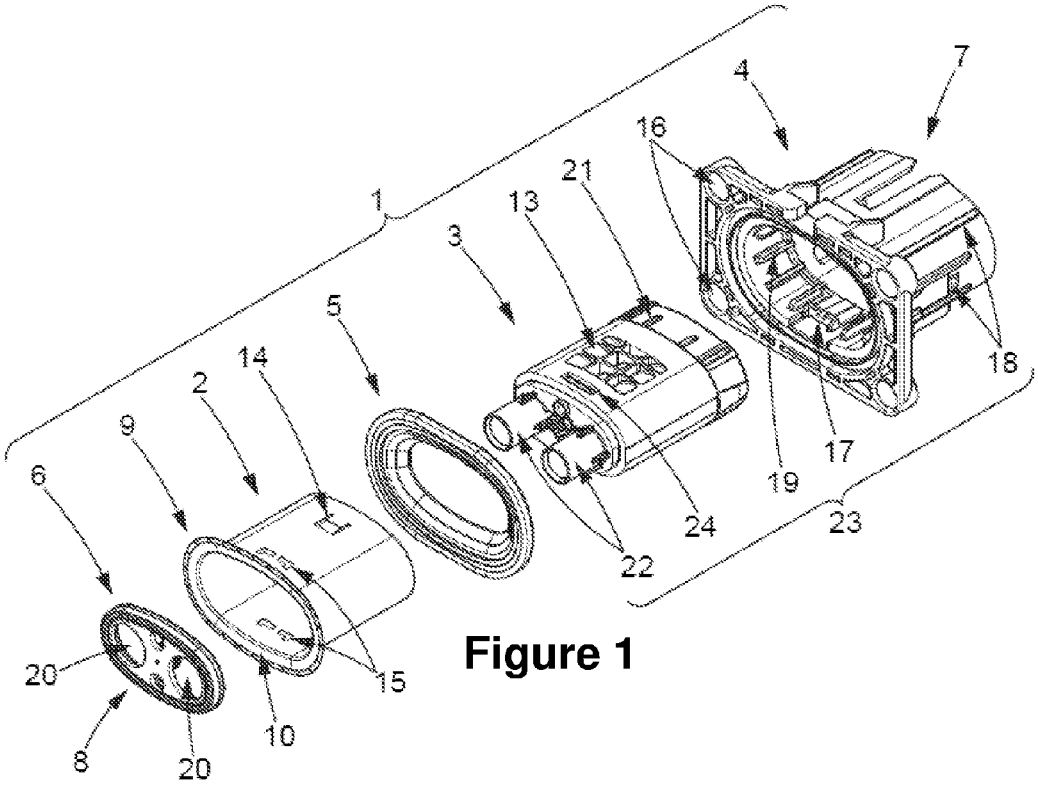
FIG. 1 is an exploded perspective-front view of the sealed and shielded electrical connector according to an embodiment.

According to an illustrative example shown in FIG. 1, the sealed shielding electrical connector 1 consists of three main parts: an inner portion 3 adapted to be mated with a respective electrical device (not shown) and to receive at least two electrical terminals of a complementary electrical connector (not shown), a single piece shielding 2 covering the inner portion 3, and an outer portion 4 surrounding the inner portion 3 commonly with the shielding 2. Between the inner portion 3, the shielding 2 and the outer portion 4, a sealing system 5, 6 is provided in order to prevent ingress of material such as water, salted water, or dust into inner space of the connector 1.

Figure 2:
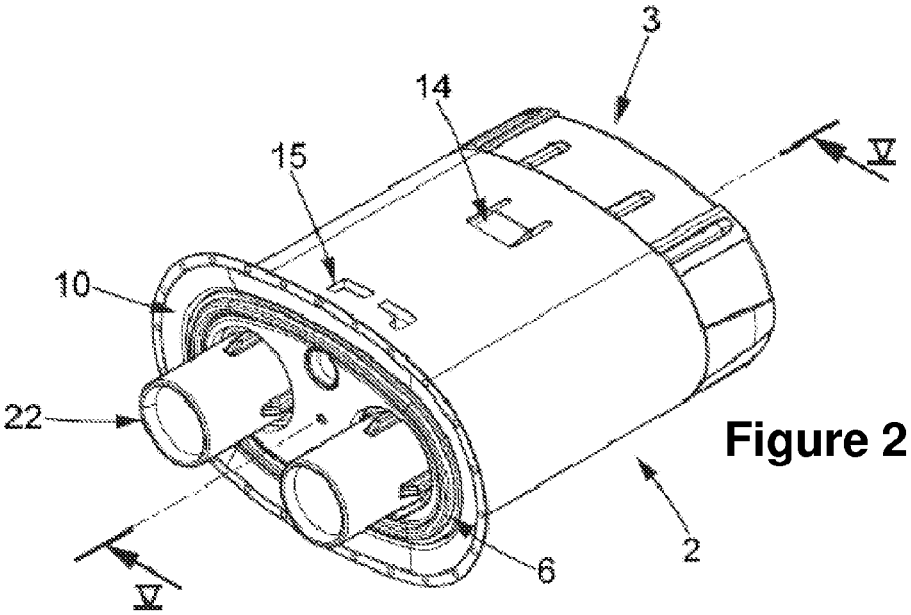
FIG. 2 is a perspective partial rear view of the composed sealed and shielded electrical connector showing a single piece shielding.
Figure 3:
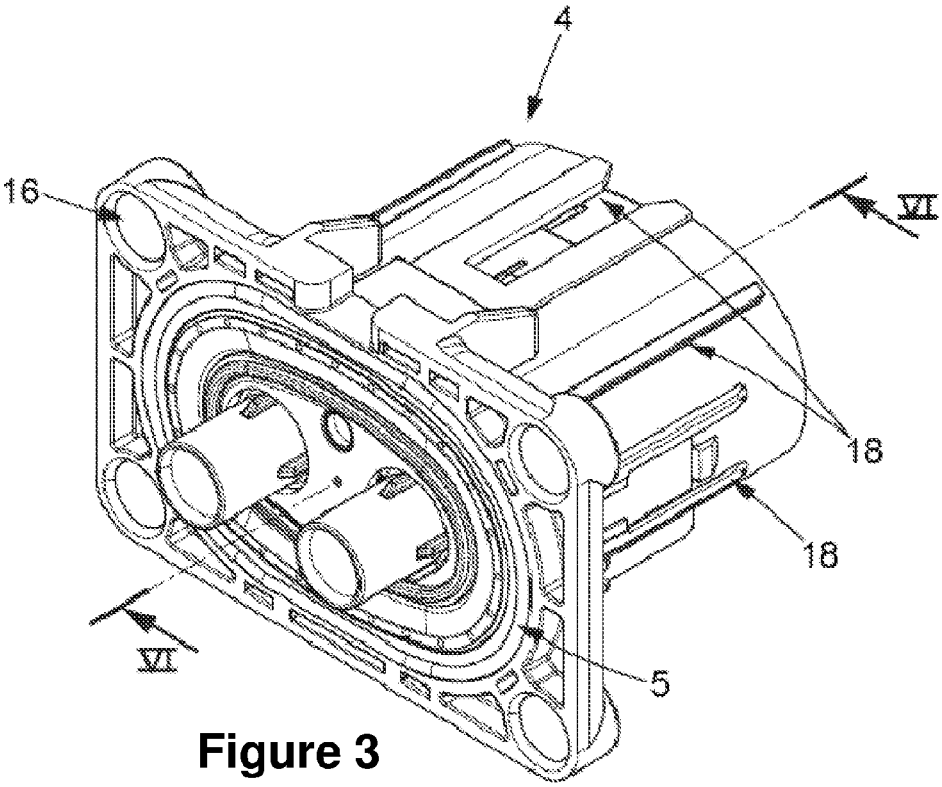
FIG. 3 is a perspective front view of the composed sealed and shielded electrical connector with the outer portion of the housing as illustrated in FIG. 1.
Figure 4:
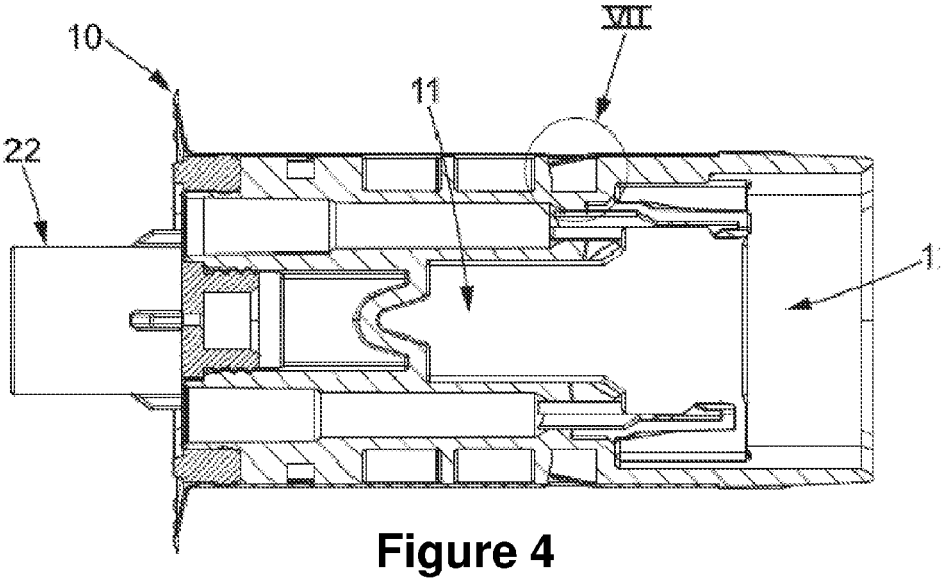
FIG. 4 is an enlarged side cross-section view V as indicated in FIG. 2.
Figure 5:
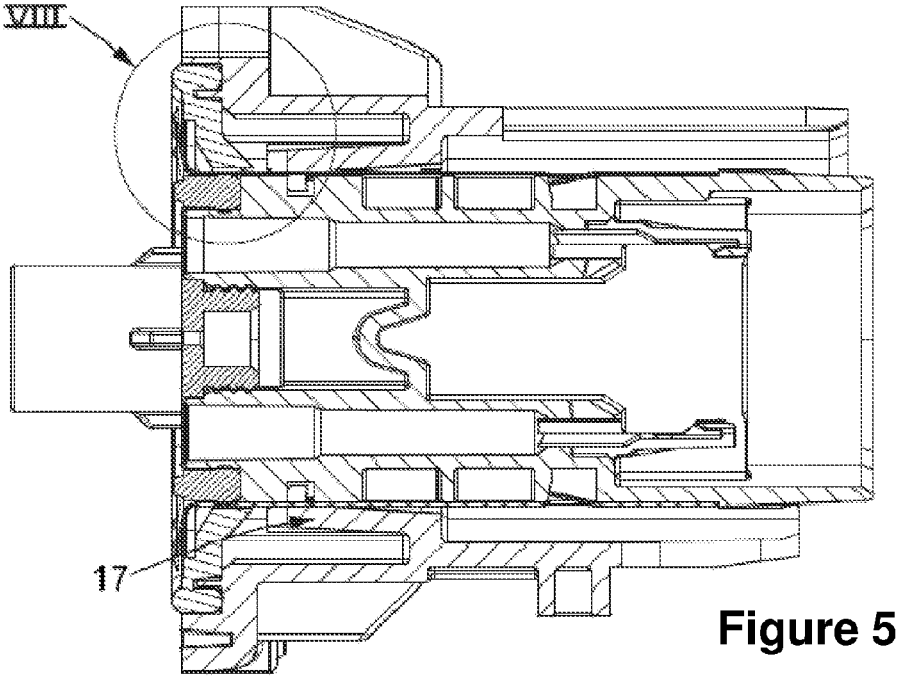
FIG. 5 is an enlarged side cross-section view VI as indicated in FIG. 3.
Figure 6:
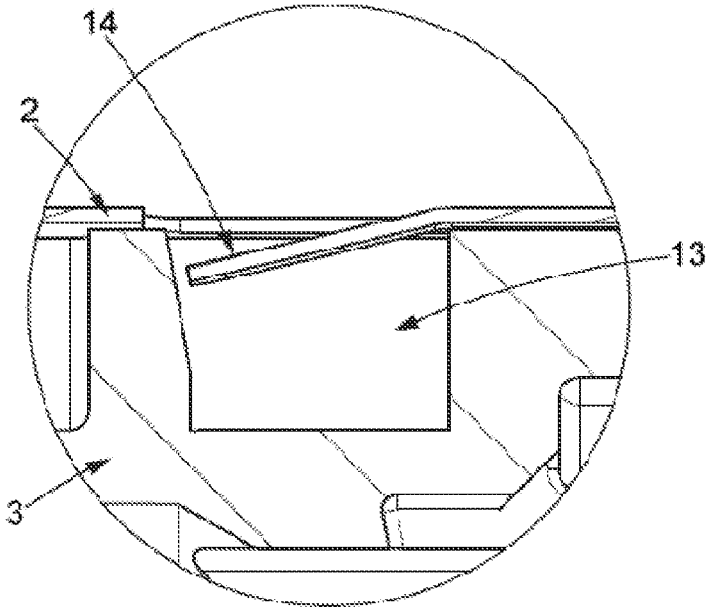
FIG. 6 is a detailed side cross-section view VII of a locking system fixing the shielding and an inner portion as shown in FIG. 4.

As shown on FIG. 2, the inner portion 3, made of electrically non-conductive (insulating) material, extends along a mating axis between a front section 21 and a rear section, and its overall shape is rather oval in the cross-sectional plane. The inner portion 3 defines a plurality of receptacles each receiving a complementary electrical terminal (not shown). In its rear section, at least two cylindrically shaped protrusions 22 are provided. These protrusions 10 are designed to be inserted through the wall of an electrical device. The front section 21 of the inner portion 3 is provided with at least two cylindrically shaped openings 12, intended to receive a complementary electrical connector including electrical terminals and wires attached to these terminals. An external surface of the inner portion 3 further includes a plurality of regularly shaped apertures 13 intended to cooperate with a locking lance 14 of the shielding 2. These apertures 13 are distributed regularly and symmetrically relative to the mating axis. The apertures 13 in the inner portion 3 and the locking lance 14 in the shield together form an example of a locking system to lock the inner portion 3 and the shield to one another. On the external surface of the inner portion 3, at least two regularly shaped grooves 24 are present. These grooves 24 serve to receive a latching element 17 of the outer portion 4 in order to lock the inner portion 3 inside the outer portion 4 (see FIG. 6).

Figure 8A:
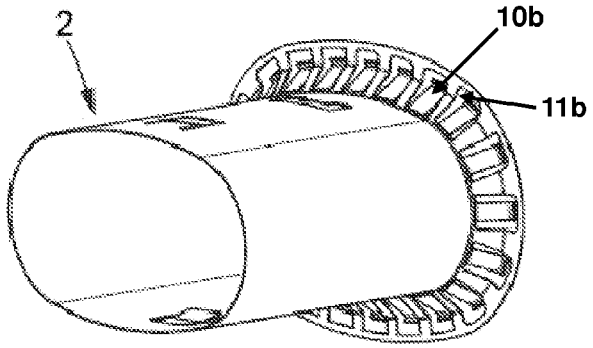
Figure 8B:
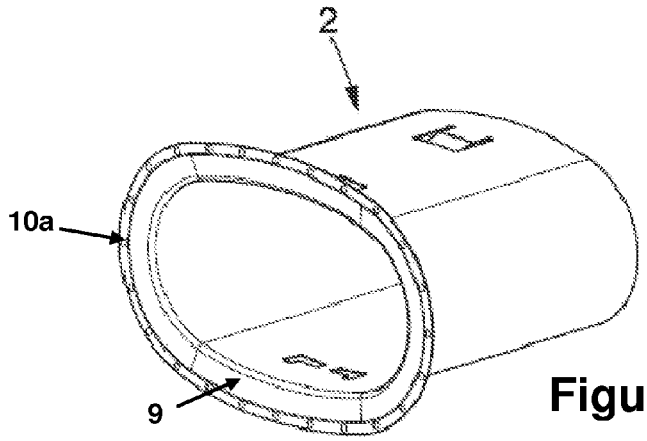
Figure 8C:
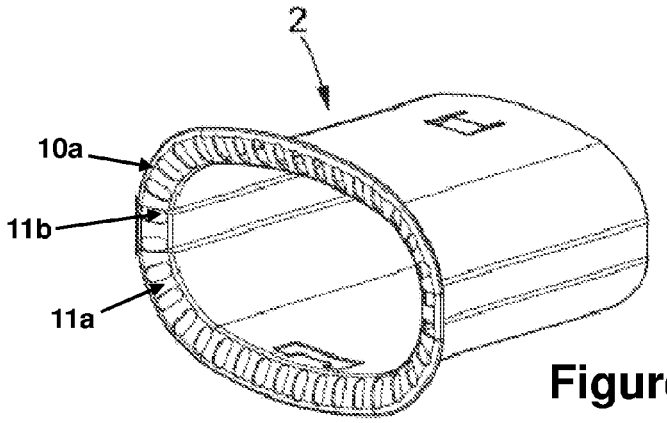

The shielding 2, made of electrically conductive material and tightly surrounding the inner portion 3, extends from the inner portion's 3 rear end to its front section 21. A rear extension 9 of the shielding 2 includes a plurality of protrusions 10 protruding from a flange extending radially relative to the mating axis (see FIG. 8*b*). In other words, the rear extension 9 extends radially relative to a center of the shielding 2, in an assembly plane transverse to the mating axis. Regarding the shielding 2, different embodiments of the rear extension 9 can be taken into account (FIG. 8*a*, 8*b*, 8*c*, with FIG. 8*a* illustrated frontward). In the embodiment of FIG. 8*c*, the radial flange and the protrusions 10 are replaced by an outer crown 10*a* linked to the remaining portion of the shielding 2 by an intermediate portion 11*a* having a plurality of openings 11*b*. These openings 11*b* provide elasticity to the intermediate portion 11*a* so that outer crown 10*a* can be efficiently pressed against a device wall or shield when the connector 1 is mounted onto it.

The embodiment of FIG. 8*a* is quite similar to the one of FIG. 8*c*. It differs mainly by the fact that elastic tongues 10*b* extend backwards in the openings 11*b*, so as to be resiliently pressed against the wall or shield of the device onto which the connector 1 is mounted.

Figure 7:
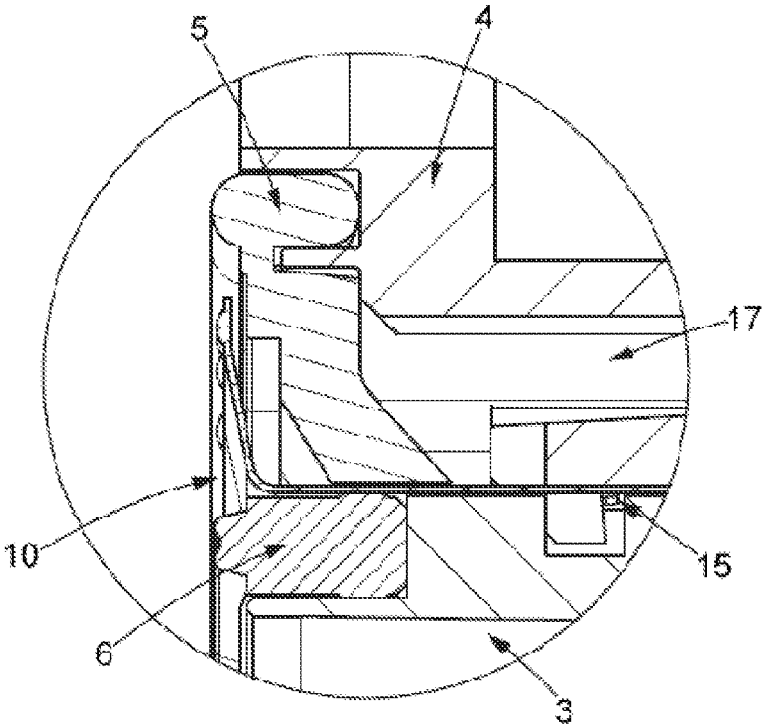
FIG. 7 is a detailed side cross-section view VIII of the sealed and shielded assembly between the inner portion and the housing as indicated in FIG. 6, and FIGS. 8*a* to 8*c* show other embodiments of a shielding.

In any case the protrusions 10, outer crown 10*a* or tongues 10*b* are designed to be placed in contact with the shield or wall of the electrical device. They are designed to compress a seal 5 onto a rear section 8 of the outer portion 4 and thus, to assist a sealing connection between the shielding 2 and the outer portion 4 (see FIG. 7). Vice versa, the seal 5 presses the protrusions 10, the outer crown 10*a* or tongues 10*b* on the shield or wall of the device on which the connector 1 is mounted, for a better electrical contact between the shielding 2 and the wall. Further, the ends of these protrusions 10 are curved and protruding backwards from the rear section of the shielding 2.

A surface of the shielding 2 also includes at least two slots 15 and a locking lance 14 (FIG. 2). These two slots 15 are distributed symmetrically relative to mating axis and intended to cooperate with latching elements 17 (FIG. 6) at the inner surface of the outer portion 4 in order to establish a fixed position between the shielding 2 and the outer portion 4. The locking lance 14, provided on the surface of the shielding 2 and symmetrically relative to the mating axis, projects into an inner space of the shielding 2 surrounding the inner portion 3. In that manner, the locking lance 14 cooperates with one of the apertures 13 in order to ensure a fixed assembly between the shielding 2 and the inner portion 3.

The internal surface of the electrically conductive shielding 2 is adjacent to the external surface of the inner portion 3 and alike, the external surface of the shielding 2 is adjacent to the internal surface of the outer portion 4.

Hence, the shielding 2 is provided as a single component which surrounds the inner portion 3. Such a shielding 2 can be performed through a deep-drawing process from a metal blank.

The outer portion 4, made of rigid electrically insulating material, covers the shielding 2 commonly with the inner portion 3 and extends from its rear section 8 to the front section 7. The rear section 8 of the outer portion 4 defines a plurality of holes 16 through which a plurality of bolts is intended to pass in order to fasten the electrical connector 1 to an electrical device (not shown) by screwing. The external surface of the outer portion 4 further defines a plurality of external projections 18. These external projections 18, regularly distributed all over the external periphery of the outer portion 4, are designed to assist an assembling process between the outer portion 4 and another electrical connector (not shown). On its inner surface, the outer portion 4 defines a plurality of inner projections 19 designed to assist an assembling process between the shielding 2 and the outer portion 4, these two parts being movable to one another for assembly. Further, the inner surface of the housing 23 defines at least two latching elements 17 situated symmetrically relative to mating axis. These latching elements 17 are designed to fit into the grooves 24 of the inner portion through the slots 15 of the shielding 2 and thus, through the shielding 2, to ensure a fixed connection between the outer portion 4 and the inner portion 3. In fact, latching elements 17 of the outer portion 4 together with the locking lance 14 of the shielding 2 enable to make the assembling process between the outer portion 4, the inner portion 3 and the shielding 2 easier and faster.

The sealing system, made of elastomeric material, consists of an inner seal 6 and an outer seal 5. The inner seal 6 is located on the rear face of the inner portion 3 and its overall shape corresponds to that of the inner portion 3 (in the present example, it is rather oval in). This inner seal 6 includes at least two round-shaped holes 20 through which the at least two cylindrically-shaped protrusions 22 of the inner portion 3 can pass. The inner seal 6 is designed to provide a sealing connection between the inner portion 3 and the shielding 2. The outer seal 5, made also of elastomeric material, is intended to sealingly fit between the shielding 2 and the outer portion 4. Compared to dimensions of the inner seal 6, the outer seal 5 is larger in such a way that it tightly surrounds the inner seal 6 commonly with the shielding 2 situated between them.

When the connector 1 is mounted onto a device wall the rear extension 9 as well as the protrusions 10 are sealingly enclosed between the outer seal 5, the inner seal 6 and the wall, so that any water which may flow over the shielding surfaces will not enter in the device.

Further, it can be understood from the above description that the latching and sealing systems are functionally and spatially separated. Where the shielding 2 has openings 11*b* for latching the outer portion 4, the inner portion 3 and the shielding 2 all together, the sealing is not efficient, but the inner and outer seals are arranged so as to prevent water or any other liquid, dust, etc. to migrate along the shield surfaces into the electrical device on which the connector 1 is mounted.

The invention is also directed to an assembly method for assembling the electrical connector with a respective electrical device and/or an electrical complementary connector. The method includes the steps of:

temporarily mounting the single piece shielding 2 on the inner portion 3, wherein the apertures 13 cooperate with the locking lance 14 of the shielding 2 in order to ensure a stable connection between them. This step is performed by sliding the shielding 2 along the mating axis with respect to the inner portion 3, until they lock together by cooperation of the locking lance 14 and the aperture 13, inserting the outer seal 5 on the rear extension 9 of the shielding 2, mounting the outer portion 4 on the shielding 2, whereby the outer seal 5 provides a sealing continuity between the rear extension 9 of the shielding 2 and the outer portion 4, and wherein the at least one latching element 17 of the outer portion 4 cooperates with the groove 24 in order to ensure a fixed position between the inner portion 3, the shield and the outer portion 4. This step is performed by sliding the outer portion 4 with respect to the assembled inner portion 3 and shielding 2 along the mating axis, mounting the inner seal 6 on the rear section of the inner portion 3, whereby the inner seal 6 provides a sealing continuity between the inner portion 3 and the shielding 2.

In variant embodiments, the steps of assembling the seals may be done in various sequences.

As a result, the shielding 2, surrounding the inner portion 3 and covered by the outer portion 4, provides a permanent and continuous electromagnetic protection from the front section 7 to the rear section 8 of the housing 23. Further, the contact portion out of the shielding 2 (the rear extension 9) is protected from any humidity that may propagate from the front of the shield, either along the inner or outer surface of the shield.

The electrical and shielding continuity are therefore ensured from a complementary electrical connector, including electrical terminals and wires, to the respective electrical device.

Obviously, the present invention is not limited to embodiments which are here above described and provided only as examples. It also includes different modifications, and alternatives that may be considered by the person skill in the art as part of the present invention, including all combinations of different embodiments here above described, taken alone or in combination.

The invention claimed is:

1. An electrical connector, comprising:

a housing made of rigid electrically insulating material having an outer portion and an inner portion designed to receive an electrical terminal, wherein the housing extends from a rear section to a front section;

a single piece shielding made of electrically conductive material surrounding the inner portion, extending from a rear section to a front section, and including a rear extension; and a sealing system comprising an outer seal disposed on the rear extension of the shielding between said shielding and the outer portion of the housing, and an inner seal disposed between the inner portion and said shielding, wherein apertures of the inner portion cooperate with a locking lance of said shielding in order to ensure a stable connection between the inner portion and the shielding and wherein at least one latching element of said outer portion cooperates with a complementary latching element of the inner portion in order to ensure a fixed position between the inner and outer portions, whereby the outer seal provides a sealing continuity between the rear extension of the shielding and the outer portion and the inner seal provides a sealing continuity between the inner portion and the shielding.

2. The electrical connector according to claim 1, wherein the rear section of the inner portion defines at least two cylindrically shaped passageways adapted to be each passed through an electrical device wall.

3. The electrical connector according to claim 1, wherein, at the front section of the housing, the inner portion defines at least two cylindrically shaped openings into which a front end of another electrical connector can be coupled.

4. The electrical connector according to claim 1, wherein the rear extension extends radially relative to a centre of the shielding in an assembly plane transverse to a mating axis.

5. The electrical connector according to claim 1, wherein, at the rear section of the housing, the outer portion defines another locking system in order to provide a screw connection between the electrical connector and a complementary electrical device.

6. The electrical connector according to claim 1, wherein an inner surface of the outer portion defines a plurality of inner projections designed to assist an assembling process between the shielding and the housing.

7. A connector assembly comprising a connector according to claim 1, and a device having a wall onto which this connector is mounted and wherein the rear extension is enclosed between the outer seal, the inner seal and the wall.

8. A method for assembling an electrical connector, comprising the steps of:

providing a housing made of rigid electrically insulating material having an outer portion and an inner portion designed to receive an electrical terminal, wherein the housing extends from a rear section to a front section;

providing a single piece shielding made of electrically conductive material surrounding the inner portion, extending from a rear section to a front section, and including a rear extension;

providing a sealing system comprising an outer seal disposed on the rear extension of the shielding between said shielding and the outer portion of the housing, and an inner seal disposed between the inner portion and said shielding;

mounting the shielding on the inner portion, wherein apertures of the inner portion cooperate with a locking lance of said shielding in order to ensure a stable connection between them;

inserting the outer seal on the rear extension of the shielding;

mounting the outer portion on the shielding, whereby the outer seal provides a sealing continuity between the rear extension of the shielding and the outer portion, and wherein at least one latching element of said outer portion cooperates with a complementary latching element of the inner portion in order to ensure a fixed position between them; and mounting the inner seal on the rear section of the inner portion, whereby said inner seal provides a sealing continuity between the inner portion and the shielding.

* * * * *